US008316589B2

(12) United States Patent
Chou et al.

(10) Patent No.: US 8,316,589 B2
(45) Date of Patent: Nov. 27, 2012

(54) DUAL-CORE SELF-CENTERING ENERGY DISSIPATION BRACE APPARATUS

(75) Inventors: Chung-Che Chou, Taipei (TW); Ying-Chuan Chen, Nantou County (TW); Ping-Ting Chung, Tainan (TW)

(73) Assignee: National Applied Research Laboratories, Taipei (TW)

( * ) Notice: Subject to any disclaimer, the term of this patent is extended or adjusted under 35 U.S.C. 154(b) by 95 days.

(21) Appl. No.: 13/082,780

(22) Filed: Apr. 8, 2011

(65) Prior Publication Data

US 2012/0000147 A1 Jan. 5, 2012

(30) Foreign Application Priority Data

Jul. 2, 2010 (TW) ..... 99121851 A
Jan. 11, 2011 (TW) ..... 00100958 A

(51) Int. Cl.
*E04B 1/98* (2006.01)
*E04H 9/02* (2006.01)

(52) U.S. Cl. ..... 52/167.1

(58) Field of Classification Search ..... 52/167.1–167.9, 52/1, 223.1, 223.13, 834, 843
See application file for complete search history.

(56) References Cited

U.S. PATENT DOCUMENTS

| | | | | |
|---|---|---|---|---|
| 4,281,487 | A * | 8/1981 | Koller | 52/167.1 |
| 5,946,866 | A * | 9/1999 | Weglewski et al. | 52/167.1 |
| 7,182,187 | B2 * | 2/2007 | Mochimaru et al. | 188/297 |
| 7,549,257 | B2 * | 6/2009 | Chuang | 52/167.1 |
| 8,002,093 | B2 * | 8/2011 | Mochimaru et al. | 188/297 |
| 2005/0257490 | A1 * | 11/2005 | Pryor et al. | 52/736.3 |
| 2006/0101733 | A1 * | 5/2006 | Jen et al. | 52/167.1 |
| 2007/0240368 | A1 * | 10/2007 | Tsai et al. | 52/167.3 |
| 2008/0016794 | A1 | 1/2008 | Tremblay et al. | |
| 2010/0005737 | A1 * | 1/2010 | Tsai et al. | 52/167.3 |

* cited by examiner

*Primary Examiner* — Brian Glessner
*Assistant Examiner* — Paola Agudelo
(74) *Attorney, Agent, or Firm* — McNees Wallace & Nurick LLC

(57) ABSTRACT

A dual-core self-centering brace apparatus is mounted to a building, and includes a first core member, at least one second core member, an outer sleeve disposed around the first and second core members, two inner abutment plates abutting respectively against two ends of the first core member, two outer abutment plates abutting respectively against two ends of the second core member, a plurality of tensioning members, and an energy-dissipating unit for retarding relative movement of the first core member and the outer sleeve. When subjected to an external force, the length of each of the tensioning elements is increased by an elongation amount, and the total length of the first core member and the outer sleeve is increased by an amount that is two times the elongation amount.

12 Claims, 20 Drawing Sheets

DUAL-CORE SELF-CENTERING ENERGY DISSIPATION BRACE APPARATUS

CROSS-REFERENCE TO RELATED APPLICATION

This application claims priority of Taiwanese Application No. 100100958, filed on Jan. 11, 2011.

BACKGROUND OF THE INVENTION

1. Field of the Invention

This invention relates to an energy dissipation brace apparatus, and more particularly to a dual-core self-centering brace apparatus capable of increasing the elongation amount thereof when subjected to an earthquake.

2. Description of the Related Art

United States Patent Application 20080016794 discloses a conventional self-centering energy dissipative brace apparatus, which includes a plurality of tensioning elements. However, the elongation amount is too small to effectively avoid the structural damage caused to the structure by the conventional brace apparatus. The elongation amount is also too small to effectively upgrade the seismic performance of the structure with short brace length.

SUMMARY OF THE INVENTION

The object of this invention is to provide a dual-core self-centering brace apparatus capable of increasing the elongation amount thereof.

According to this invention, there is provided a brace apparatus adapted to be connected to a building, the brace apparatus comprising:

an elongate first core member having a main body and at least one extension section connected fixedly to the main body and adapted to connect with the building;

at least one elongate second core member parallel to the first core member;

an outer sleeve including an outer steel tube disposed around the first and second core members and having an inner surface facing the first and second core members, and at least one steel plate connected fixedly to an end of the outer steel tube and adapted to connect with the building;

a pair of first and second inner abutment plates respectively adjacent to two opposite ends of the first core member, two ends of the second core member abutting respectively against the first and second inner abutment plates;

a pair of first and second outer abutment plates abutting respectively against two opposite ends of the outer sleeve;

at least one first tensioning element adjacent to the first core member and extending in the outer sleeve along a longitudinal direction of the first core member, the first tensioning element being fastened to the first inner abutment plate at an end thereof and to one of the second inner and outer abutment plates at an opposite end thereof;

at least one second tensioning element extending in the outer sleeve in a longitudinal direction of the outer sleeve and adjacent to the inner surface of the outer sleeve, the second tensioning element being fastened to the first outer abutment plate at an end thereof and to one of the second inner and outer abutment plates at an opposite end thereof; and an energy-dissipating unit for retarding relative movement between the first core member and the outer sleeve and between the first and second outer abutment plates;

wherein, when a force is applied to the first core member, relative movement occurs between the first inner and outer abutment plates, between the second inner and outer abutment plates, and among the first and second core members and the outer sleeve, so that the length of each of the first and second tensioning elements is increased by an elongation amount, and the total length of the first core member and the outer sleeve is increased by an amount that is two times the elongation amount.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
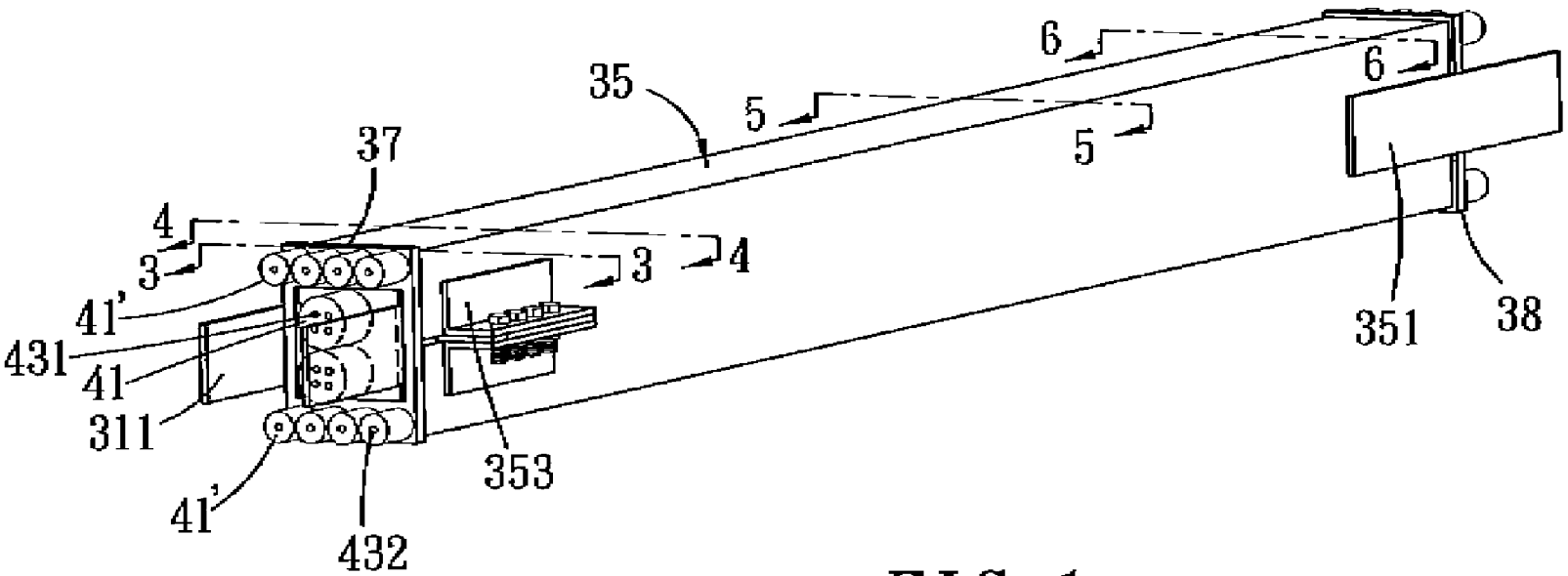
FIG. 1 is an assembled perspective view of the first preferred embodiment of a dual-core self-centering brace apparatus according to this invention.

Before the present invention is described in greater detail in connection with the preferred embodiments, it should be noted that similar elements and structures are designated by like reference numerals throughout the entire disclosure.

Referring to FIGS. 1 to 6, the first preferred embodiment of a dual-core self-centering brace apparatus according to this invention includes an elongate first core member 31, two elongate second core members 32 located respectively to two sides of the first core member 31, a pair of first and second inner abutment plates 33, 34 respectively adjacent to front and rear ends of the first core member 31 in such a manner that the first core member 31 is disposed between the first and second abutment plates 33, 34, an outer sleeve 35 disposed around the first and second core members 31, 32 and having an inner surface 354 (see FIG. 4) facing the first and second core members 31, 32, a pair of first and second outer abutment plates 37, 38 respectively adjacent to front and rear ends of the outer sleeve 35 in such a manner that the outer sleeve 35 is disposed between the first and second outer abutment plates 37, 38, a plurality of elongate first tensioning elements 431, a plurality of elongate second tensioning elements 432 adjacent to the inner surface 354 of the outer sleeve 35, a plurality of first fasteners 41 for fastening respectively the first tensioning elements 431 to the first inner abutment plate 33, a plurality of second fasteners 42 for fastening respectively the first tensioning elements 431 to the second inner abutment plate 34, a plurality of third fasteners 41' for fastening respectively the second tensioning elements 432 to the first outer abutment plate 37, and a plurality of fourth fasteners 42 for fastening respectively the second tensioning elements 432 to the second outer abutment plate 38. Each of the first and second tensioning elements 431, 432 is made from a stretchable material, such as fiberglass, carbon glass, a twisted steel cable, a steel rod, or an alloy rod.

The first core member 31 includes: a main body 310 configured as an elongate rod, being H-shaped in cross section, and having two upright side plate portions 310' (see FIG. 5) and a generally horizontal middle plate portion 310" (see FIG. 5) connected between the side plate portions 310'; two extension sections 311 welded respectively to front ends of the side plate portions 310'; two energy-dissipating plates 312 extending respectively and outwardly from the side plate portions 310' away from each other; and a plurality of spacer plates 313 disposed fixedly on top and bottom surfaces of the side plate portions 310'. The extension sections 311 are parallel to the side plate portions 310', and are used for connection with a building. The energy-dissipating plates 312 are perpendicular to the side plate portions 310'.

Each of the second core members 32 is parallel to the first core member 31, and includes a rectangular inner steel tube 320 and a plurality of spacer plates 321 welded to top and bottom surfaces of the inner steel tube 320. Each of the inner steel tubes 320 of the second core members 32 is disposed between the side plate portions 310'. One of the inner steel tubes 320 is disposed above the middle plate portion 310", and the other of the inner steel tubes 320 is disposed under the middle plate portion 310". The first inner and outer abutment plates 33, 37 abut against front ends of the inner steel tubes 320. The second inner and outer abutment plates 34, 38 abut against rear ends of the inner steel tubes 320.

The outer sleeve 35 includes an outer steel tube 350 formed with two aligned slots 352 (see FIG. 11) in a front end thereof, each of which has an open front end, two steel plates 351 welded respectively to two opposite sides of a rear end of the outer steel tube 350, and two pairs of angle steels 351. Each pair of the angle steels 351 clamp a respective one of the energy-dissipating plates 312 therebetween, are interconnected fixedly by a lock bolt 36, and are used to connect with the building.

The energy-dissipating plates 312 extend respectively through the slots 352, and cooperate with the angle steels 353 and the lock bolts 36 to constitute an energy-dissipating unit. Due to the presence of the spacer plates 313, the main body 310 is spaced apart from each of the inner and outer inner steel tubes 320, 350 of the second core members 32 and the outer sleeve 35 by a predetermined distance.

In addition, due to the presence of the spacer plates 321, each of the second core members 32 is spaced apart from the main body 310 of the first core member 31 and the outer steel tube 350 of the outer sleeve 35 by a predetermined distance.

In this embodiment, the number of the first tensioning elements 431 is eight. Four of the first tensioning elements 431 extend through a lower half portion of the inner steel tube 320 of the upper second core member 32, and the remaining four first tensioning elements 431 extend through an upper half portion of the inner steel tube 320 of the lower second core member 32. Each of the first tensioning elements 431 has two ends that extend respectively through a corresponding one of holes in the first inner abutment plate 33 and a corresponding one of holes in the second inner abutment plate 34 and that are fastened respectively to the first and second inner abutment plates 33, 34 by an assembly of the first fasteners 41 and an assembly of the second fasteners 42, respectively. As such, an initial tensioning force is provided to each of the first tensioning elements 431. The number of the second tensioning elements 432 is also eight. Four of the second tensioning elements 432 extend through a top end portion of the outer sleeve 35, and the remaining four second tensioning elements 432 extend through a bottom end portion of the outer sleeve 35. Each of the second tensioning elements 432 has two ends that extend respectively through a corresponding one of holes in the first outer abutment plate 37 and a corresponding one of holes in the second outer abutment plate 38 and that are fastened respectively to the first and second outer abutment plates 37, 38 by an assembly of the third fasteners 41' and an assembly of the fourth fasteners 42', respectively. As such, an initial tensioning force is provided to each of the second tensioning elements 432.

Figure 8:
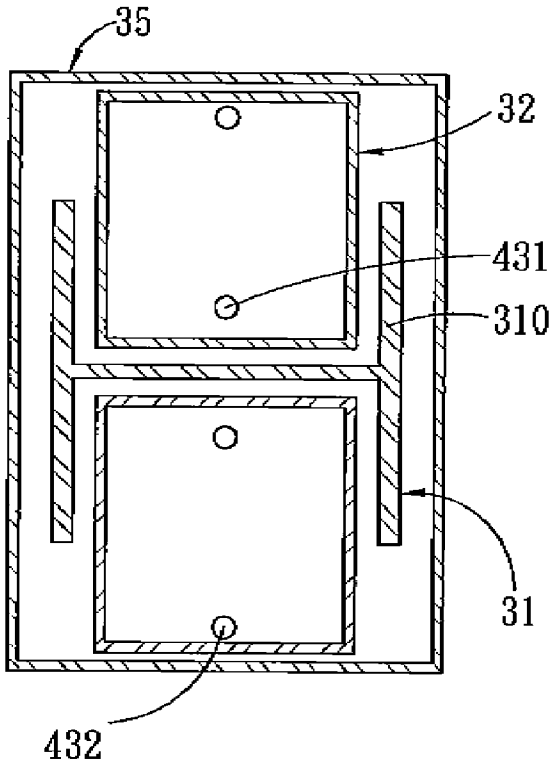
FIG. 8 is a view similar to FIG. 5 but illustrating another modification to the number and arrangement of the first and second tensioning elements.
Figure 7:
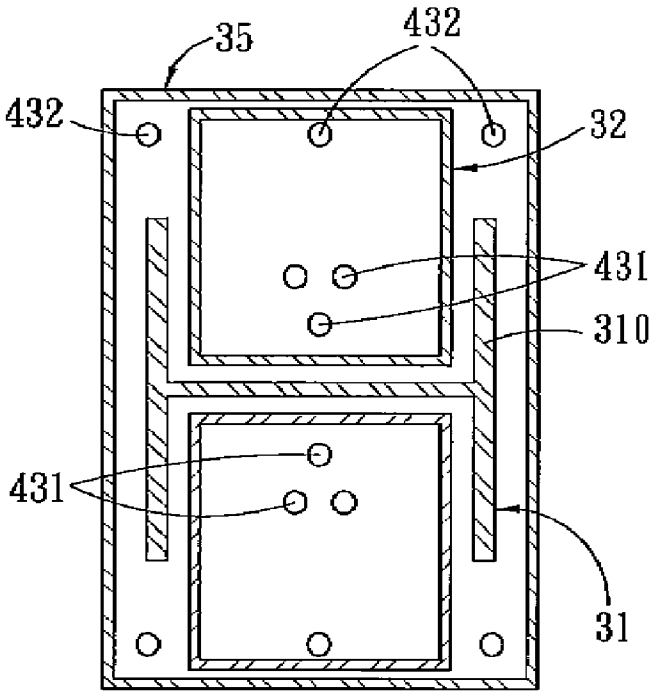
FIG. 7 is a view similar to FIG. 5 but illustrating a modification to the number and arrangement of first and second tensioning elements.

It should be noted that, the total number and arrangement of the first and second tensioning elements 431, 432 can be changed. For example, the total number of the first and second tensioning elements 431, 432 may be changed to twelve, as shown in FIG. 7, or four, as shown in FIG. 8.

Figure 2:
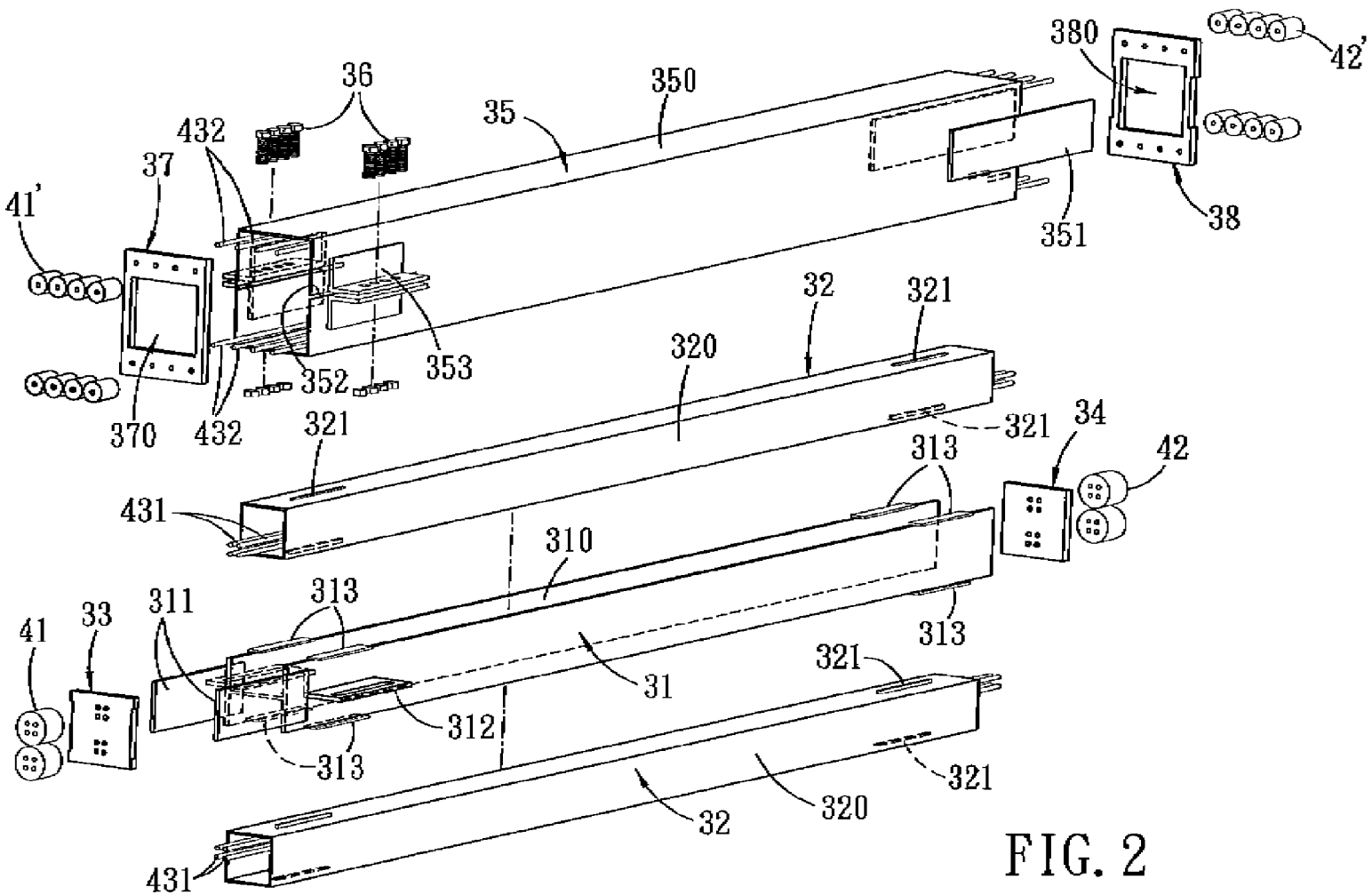
FIG. 2 is an exploded perspective view of the first preferred embodiment.
Figure 4:
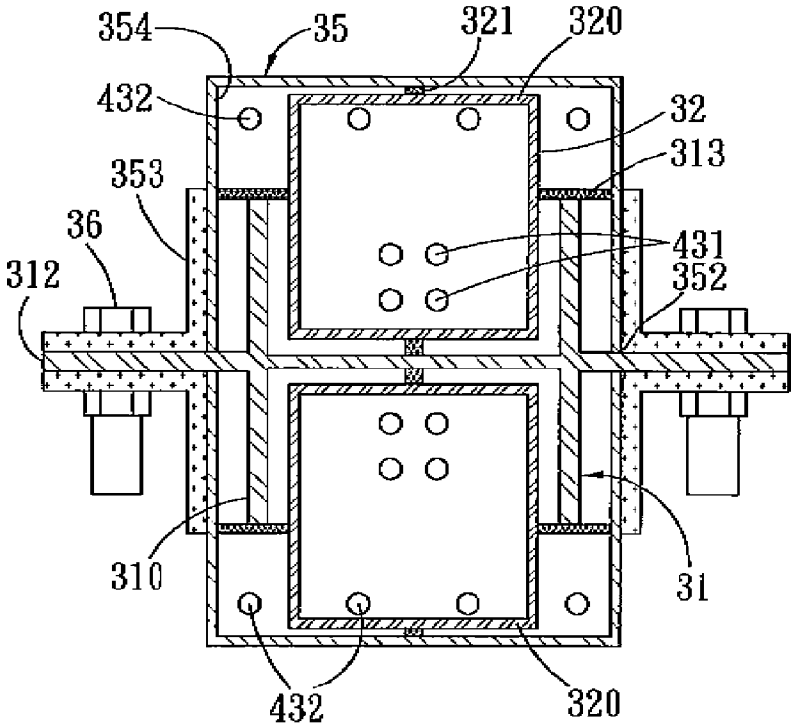
FIG. 4 is a sectional view taken along line 4-4 in FIG. 1.
Figure 3:
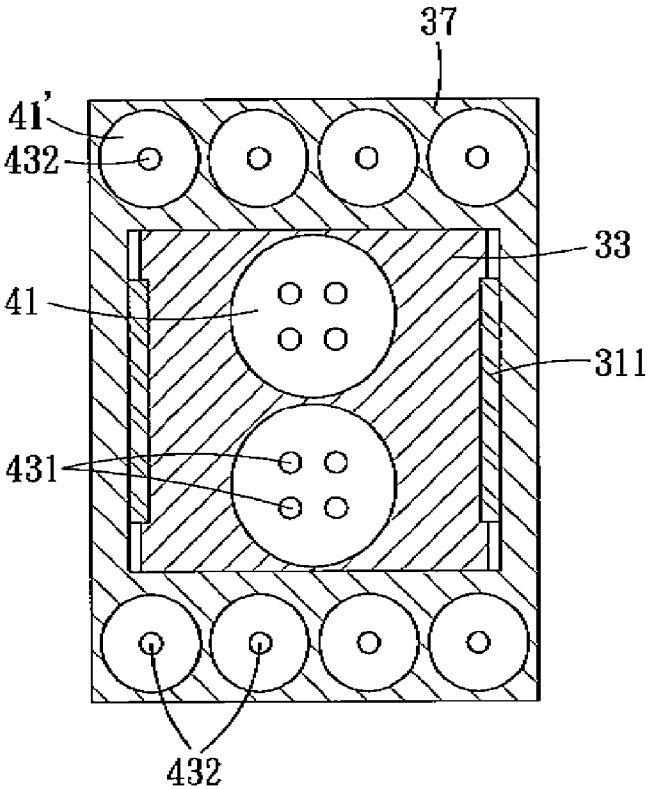
FIG. 3 is a sectional view taken along line 3-3 in FIG. 1.
Figure 6:
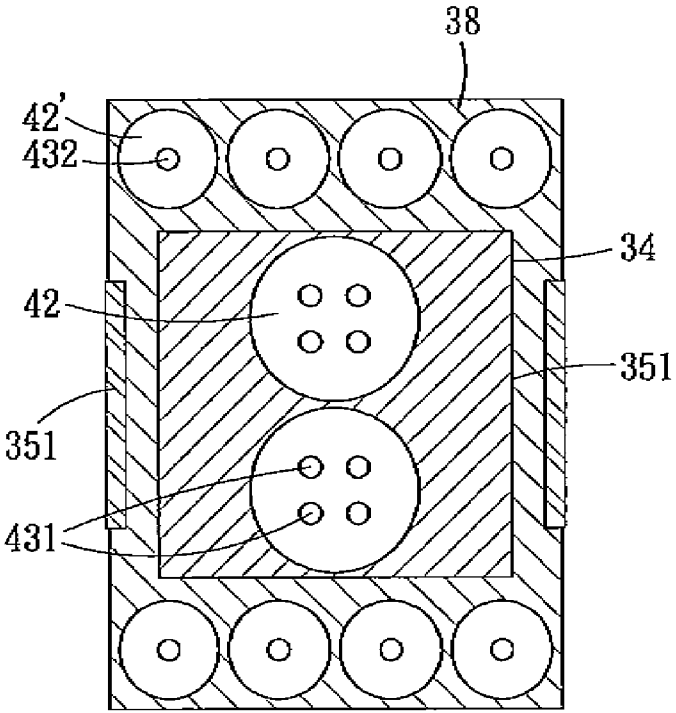
FIG. 6 is a sectional view taken along line 6-6 in FIG. 1.
Figure 5:
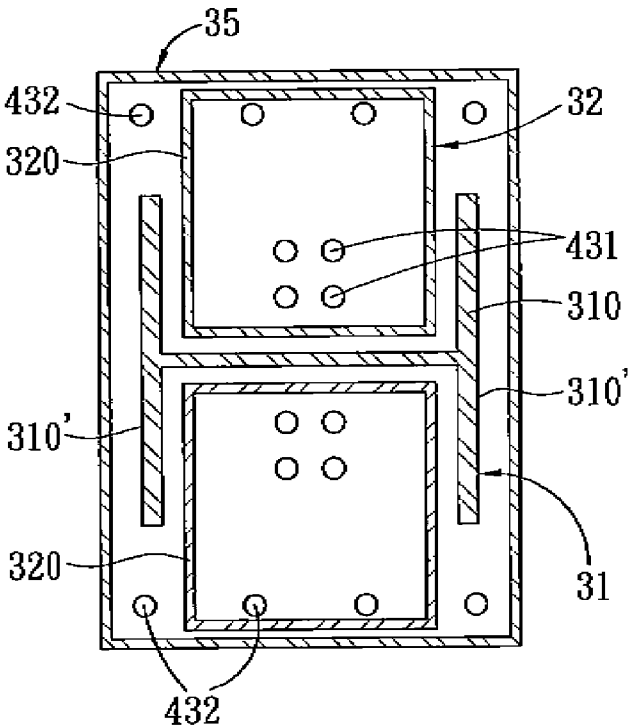
FIG. 5 is a sectional view taken along line 5-5 in FIG. 1.
Figure 9:
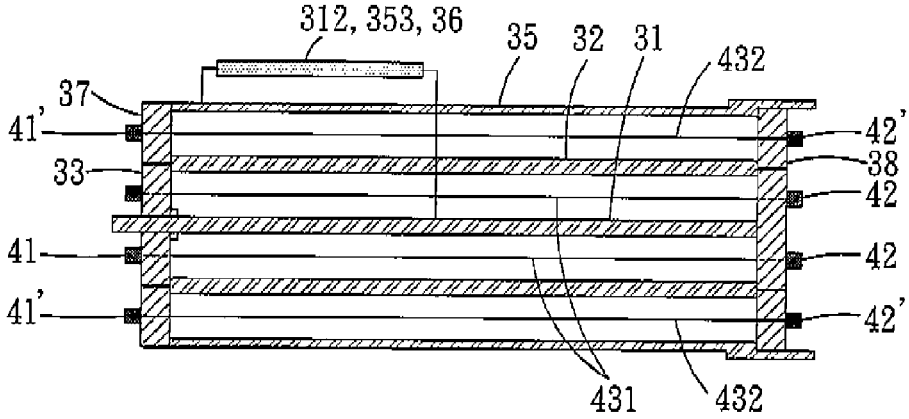
FIG. 9 is a schematic sectional view of the first preferred embodiment, illustrating the mechanical performances of the components of the brace apparatus when no force is applied.

With particular reference to FIGS. 2 and 9, each of the first and second outer abutment plates 37, 38 is configured as a rectangular frame, and defines an accommodating space 370, 380. When no external force is applied to the brace apparatus, the first and second inner abutment plates 33, 34 are disposed respectively within the accommodating spaces 370, 380 in the first and second outer abutment plates 37, 38, and are coplanar with the first and second outer abutment plates 37, 38, respectively. In this state, the first inner and outer abutment plates 33, 37 abut against the front ends of the first and second core members 31, 32 and the outer sleeve 35, so that the elongation amount of each of the first and second tensioning elements 431, 432 is zero.

Figure 10:
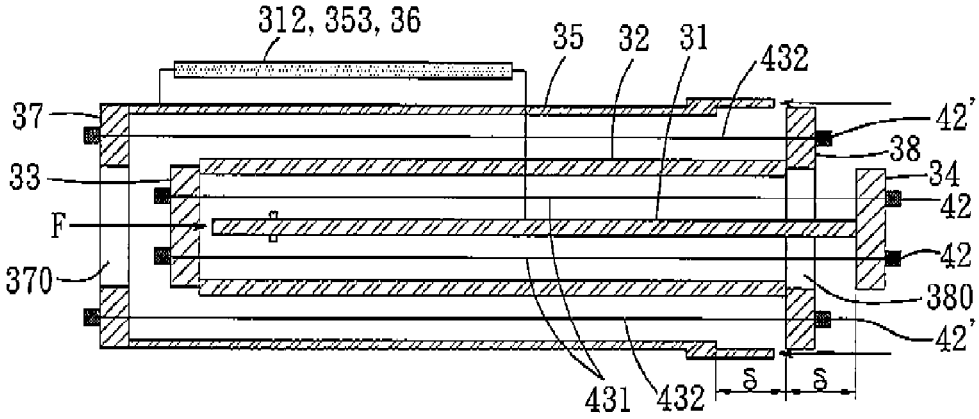
FIG. 10 is a schematic sectional view of the first preferred embodiment, illustrating the mechanical performances of the components of the brace apparatus when a pushing force is applied.
Figure 17:
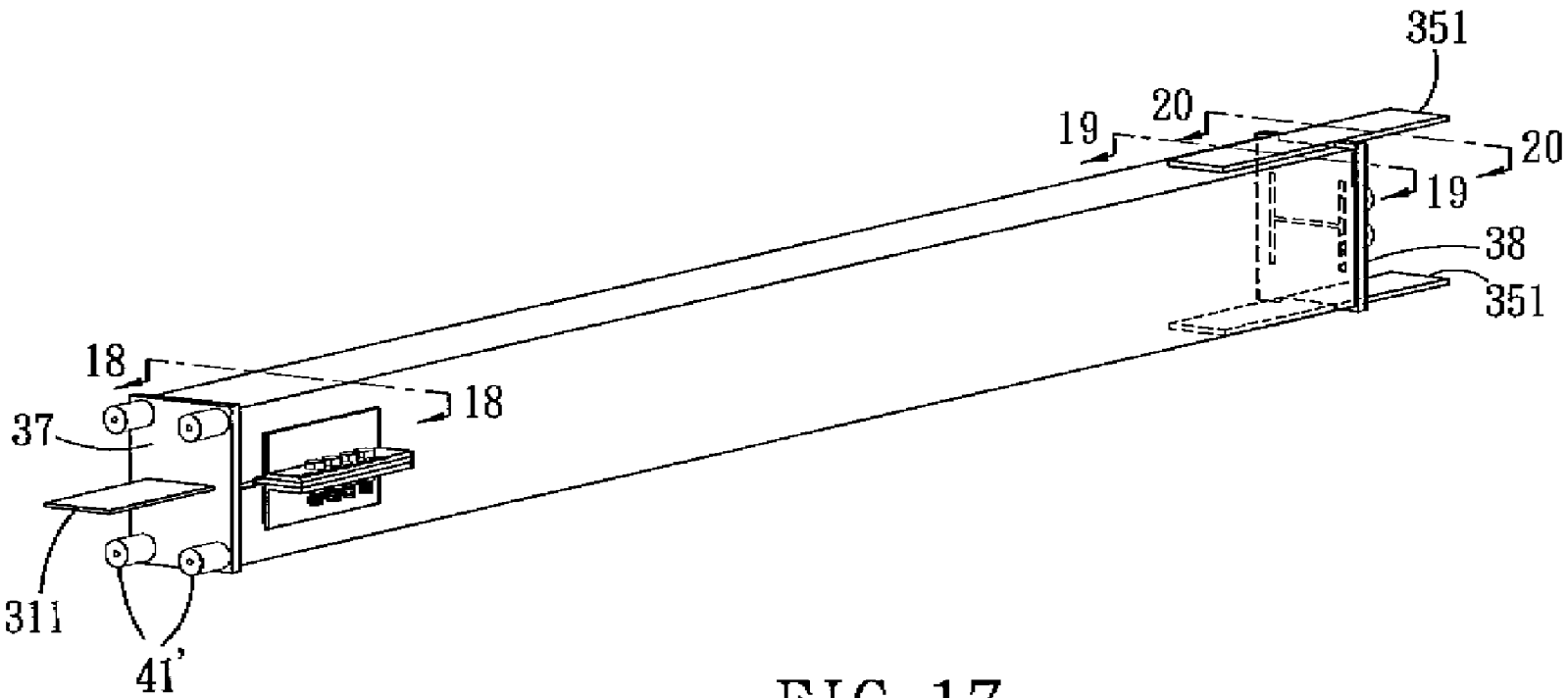
FIG. 17 is an assembled perspective view of the fourth preferred embodiment of a dual-core self-centering brace apparatus according to this invention.
Figure 19:
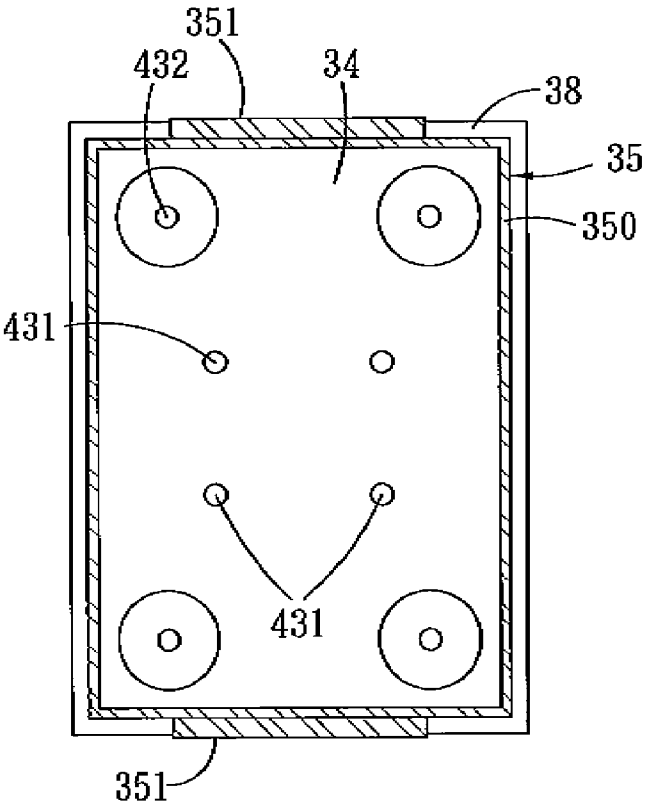
FIG. 19 is a sectional view taken along line 19-19 in FIG. 17.

With particular reference to FIGS. 2 and 10, when a pushing force (F) is applied to the brace apparatus, it is transmitted from the building onto the second inner abutment plate 34 via the extension sections 311 of the first core member 31. Hence, the first tensioning elements 431 are pulled to transmit the force onto the first inner abutment plate 33. Thereafter, the force is transmitted from the first inner abutment plate 33 onto the second outer abutment plate 38 by the second core members 32, from the second abutment plate 38 onto the first outer abutment plate 37 by the second tensioning elements 432, and finally from the first outer abutment plate 37 onto the building via the outer sleeve 35. As a result, relative movement occurs between the first inner and outer abutment plates 33, 37, between the second inner and outer abutment plates 34, 38, and among the first and second core members 31, 32 and the outer sleeve 35. During relative movement of the first core member 31 and the outer sleeve 35, the relative movement is retarded by the energy-dissipating unit including the energy-dissipating plates 312, the angle steels 353, and the lock bolts 36. As such, since the length of either the first tensioning elements 431 connected between the first and second inner abutment plates 33, 34 or the second tensioning elements 432 connected between the first and second outer abutment plates 37, 38 is increased by an elongation amount (δ), as shown in FIG. 17, the first core member 31 is moved relative to the outer sleeve 35 by 2 δ. In other words, the total length of the brace apparatus is increased by an increment of 2 δ, which is two times that of the above-mentioned brace apparatus without causing any structural damage.

Figure 11:
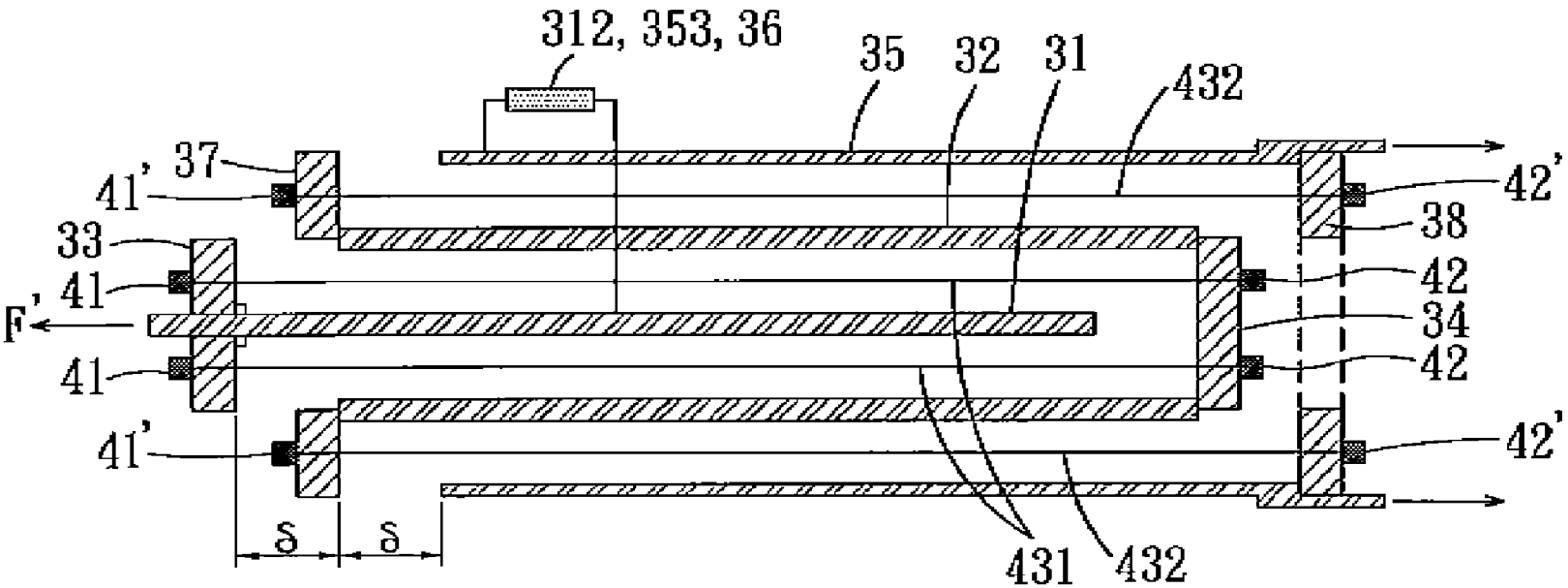
FIG. 11 is a schematic sectional view of the first preferred embodiment, illustrating the mechanical performances of the components of the brace apparatus when a pulling force is applied.
Figure 18:
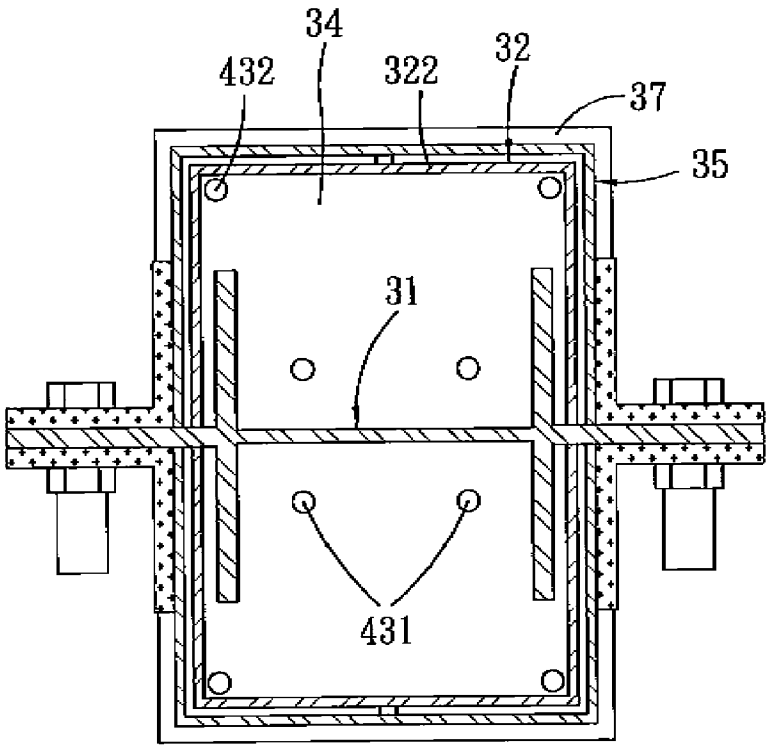
FIG. 18 is a sectional view taken along line 18-18 in FIG. 17.
Figure 20:
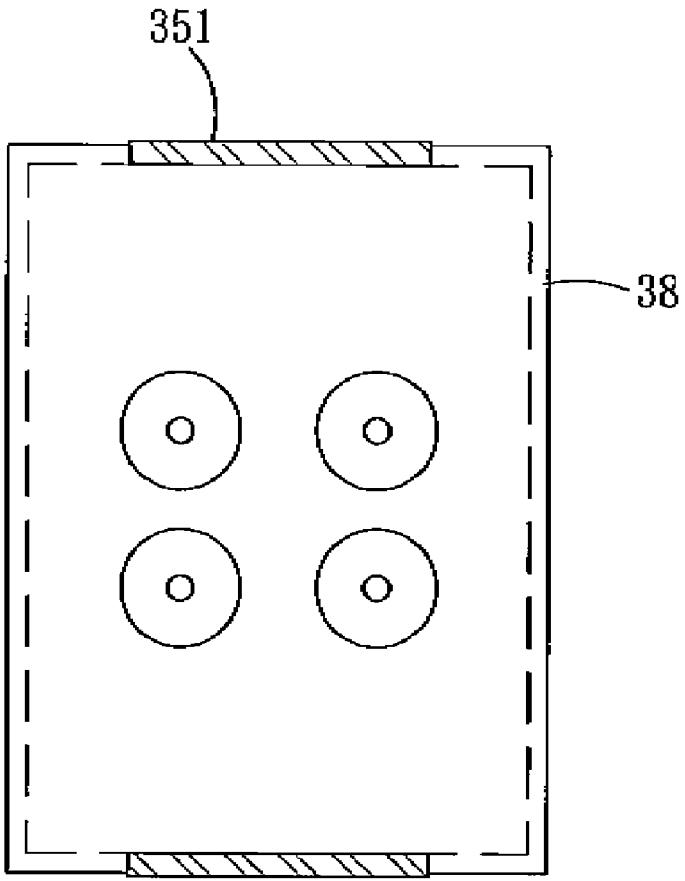
FIG. 20 is a sectional view taken along line 20-20 in FIG. 17.
Figure 21:
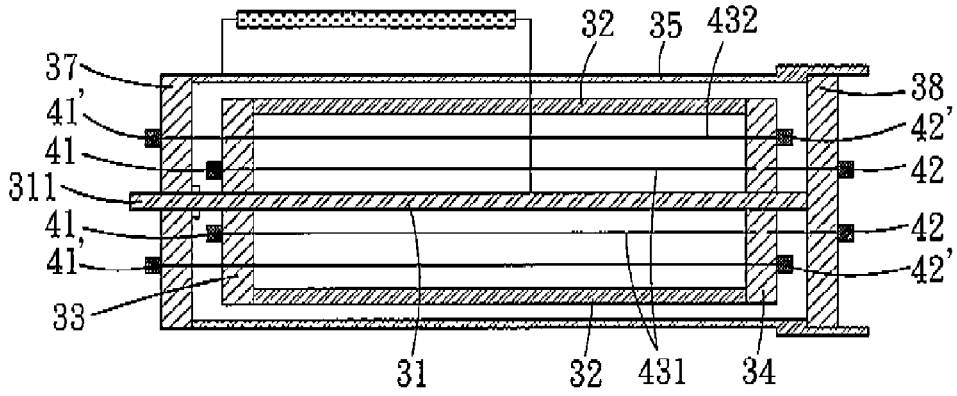
FIG. 21 is a schematic sectional view of the fourth preferred embodiment, illustrating the mechanical performances of the components of the brace apparatus when no force is applied.

With particular reference to FIGS. 2 and 11, when a pulling force (F') is applied to the brace apparatus, it is transmitted from the building onto the first inner abutment plate 33 via the extension sections 311. Thereafter, the force is transmitted from the first inner abutment plate 33 onto the second inner abutment plate 34 by the first tensioning elements 431, from the second inner abutment plate 34 onto the first outer abutment plate 37 by the second core members 32, from the first outer abutment plate 37 onto the second outer abutment plate 38 by the second tensioning elements 432, and finally from second outer abutment plate 38 onto the building via the outer sleeve 35. As a result, relative movement occurs between the first inner and outer abutment plates 33, 37, between the second inner and outer abutment plates 34, 38, and among the first and second core members 31, 32 and the outer sleeve 35. During relative movement of the first core member 31 and the outer sleeve 35, energy is dissipated by the energy-dissipating unit including the energy-dissipating plates 312, the angle steels 353, and the lock bolts 36. As such, since the length of either the first tensioning elements 431 disposed within the first and second core members 31, 32 or the second tensioning elements 432 disposed within the outer sleeve 35 is increased by an elongation amount (δ) as shown in FIG. 18, the first core member 31 is moved relative to the outer sleeve 35 by 2 δ. In other words, the total length of the brace apparatus is increased by an increment of 2 δ, which is two times that of the above-mentioned brace apparatus without causing any structural damage.

Figure 12:
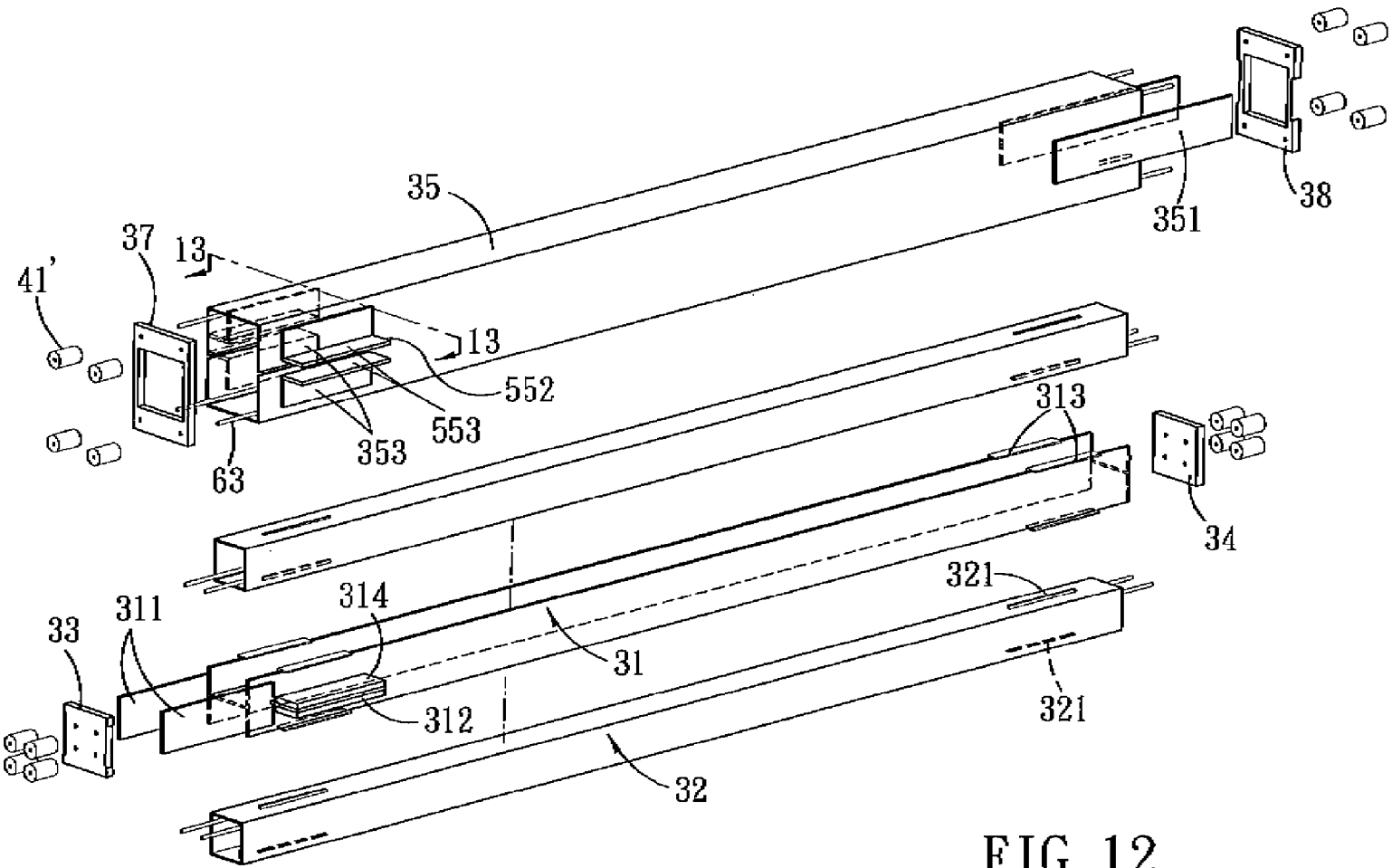
FIG. 12 is an exploded perspective view of the second preferred embodiment of a dual-core self-centering brace apparatus according to this invention.
Figure 13:
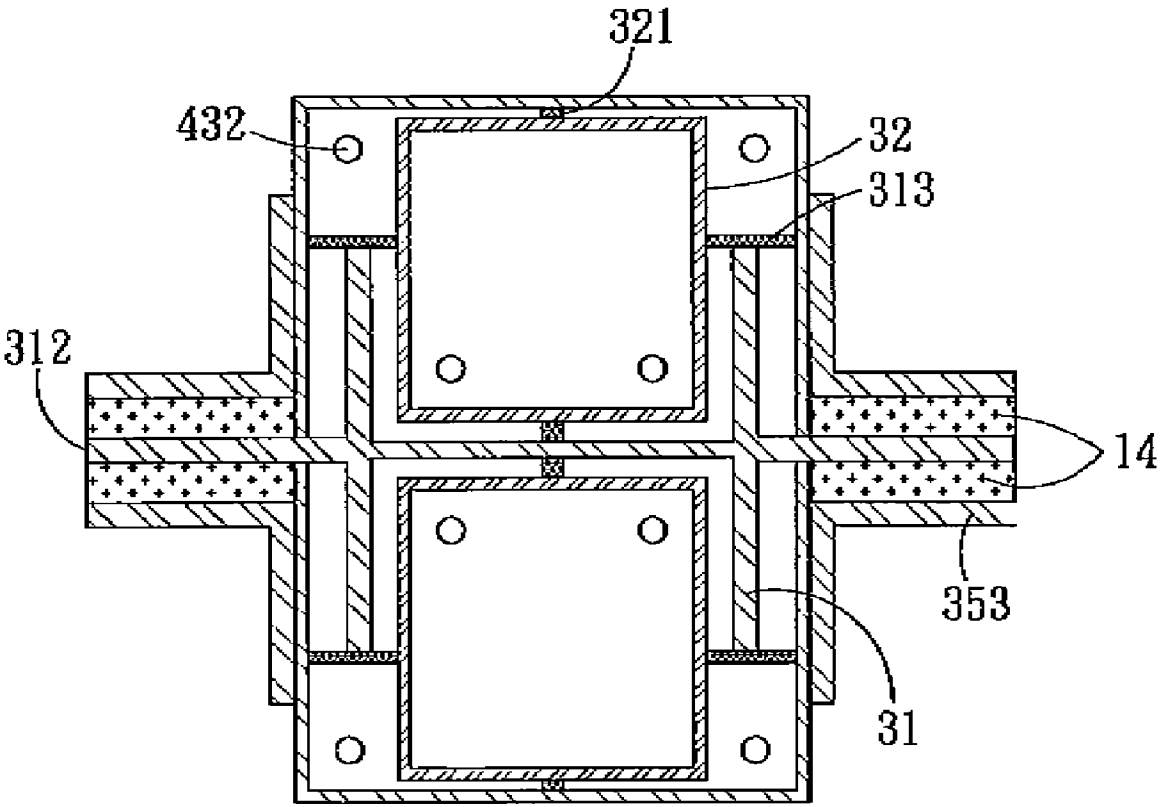
FIG. 13 is a sectional view taken along line 13-13 in FIG. 12.

FIGS. 12 and 13 show the second preferred embodiment of a dual-core self-centering brace apparatus according to this invention, which differs from the first preferred embodiment in that the lock bolts 36 are replaced with two adhesive elastic damping materials 14, respectively. Each of the adhesive elastic damping materials 14 is connected between a corresponding pair of the angle steels 353.

Figure 14:
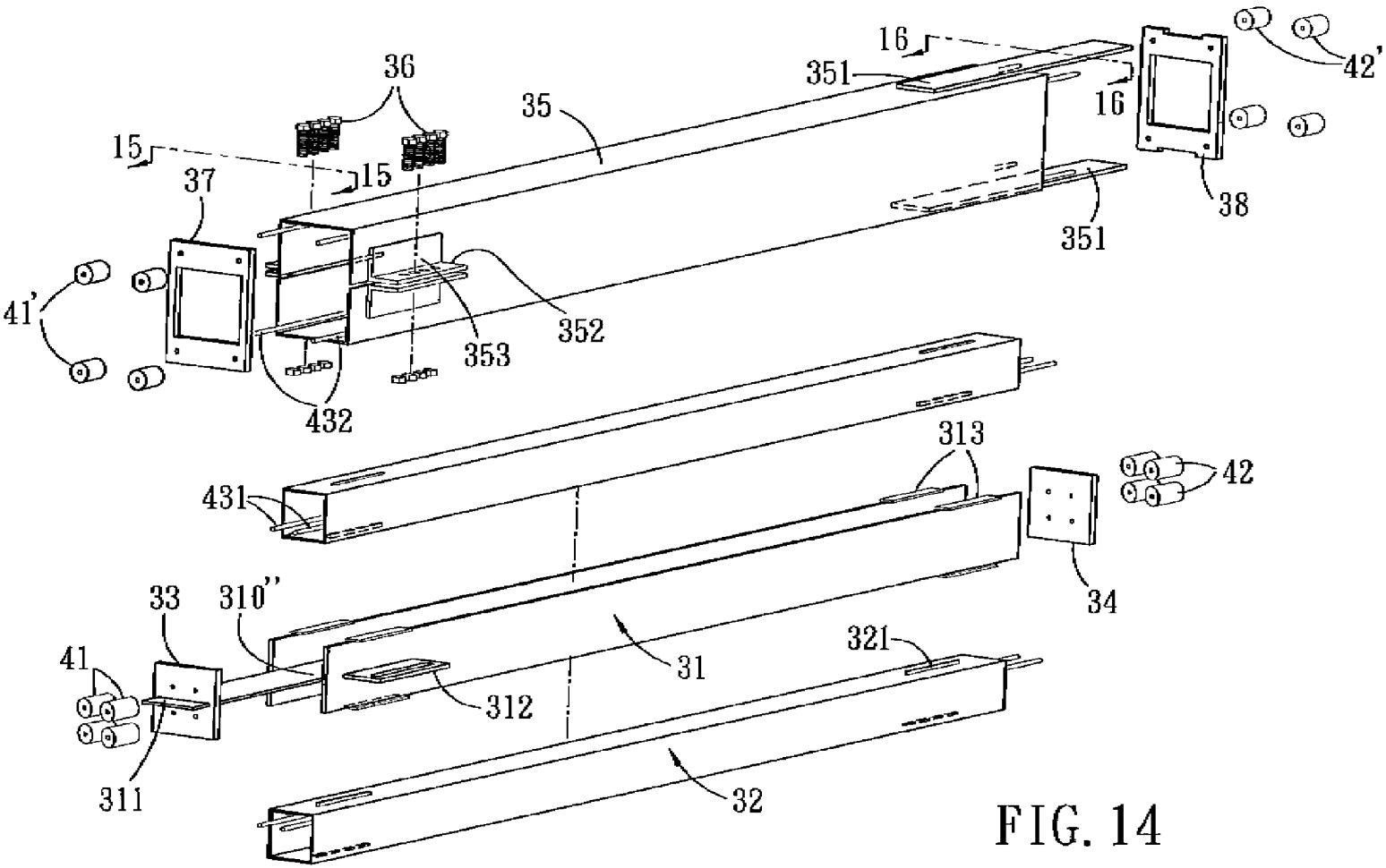
FIG. 14 is an exploded perspective view of the third preferred embodiment of a dual-core self-centering brace apparatus according to this invention.
Figure 16:
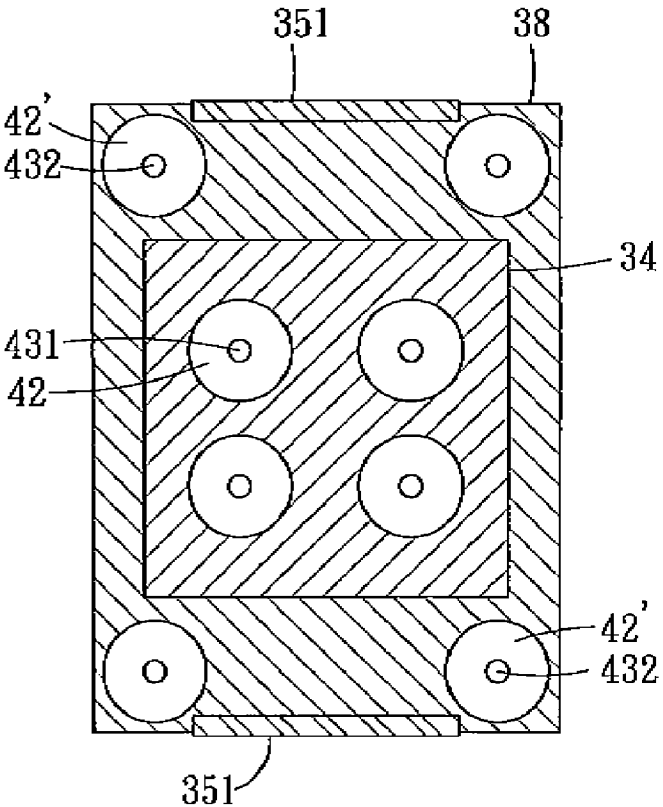
FIG. 16 is a sectional view taken along line 16-16 in FIG. 14.
Figure 15:
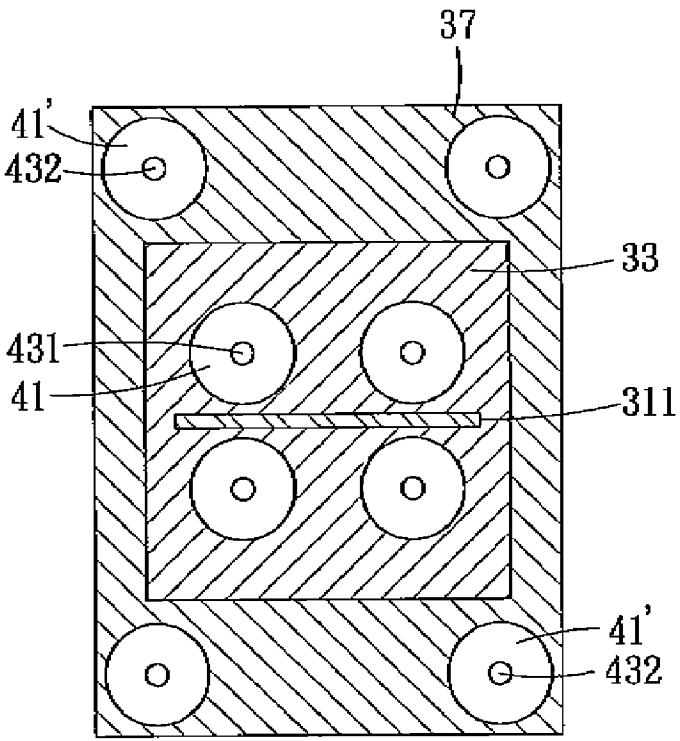
FIG. 15 is a sectional view taken along line 15-15 in FIG. 14.

FIGS. 14 to 16 show the third preferred embodiment of a dual-core self-centering brace apparatus according to this invention, which is similar in construction to the first preferred embodiment. The main difference resides in that, the first core member 31 includes only one extension section 311, which is welded to a front end of the middle plate portion 310", and the spacer plates 351 are welded to top and bottom surfaces of the outer sleeve 35.

FIGS. 17 to 20 show the fourth preferred embodiment of a dual-core self-centering brace apparatus according to this invention, which is different from the first preferred embodiment in the following. In this embodiment, the brace apparatus includes only one second core member 32, and the second core member 32 includes a steel tube 322 that is disposed to surround the main body 310 of the first core member 31. Each of the first and second outer abutment plates 37, 38 is not formed with any accommodating space. The first outer abutment plate 37 is disposed in front of the first inner abutment plate 33. The second outer abutment plate 38 is disposed behind the second inner abutment plate 34. The number of the first tensioning elements 431 of this embodiment is but not limited to four. Each of the first tensioning elements 431 has a front end portion extending through the first inner abutment plate 33 and fastened to the first inner abutment plate 33 by the corresponding first fastener 41, and a rear end portion extending through the second inner and outer abutment plates 34, 38 and fastened to the second outer abutment plate 38 by the corresponding second fastener 42. The number of the second tensioning elements 432 of this embodiment is but not limited to four. Each of the second tensioning elements 432 has a front end portion extending through the first inner and outer abutment plates 33, 37 and fastened to the first outer abutment plate 37 by the corresponding third fastener 41', and a rear end portion extending through the second inner abutment plate 38 and fastened to the second inner abutment plate 38 by the corresponding fastener 42'.

Figure 22:
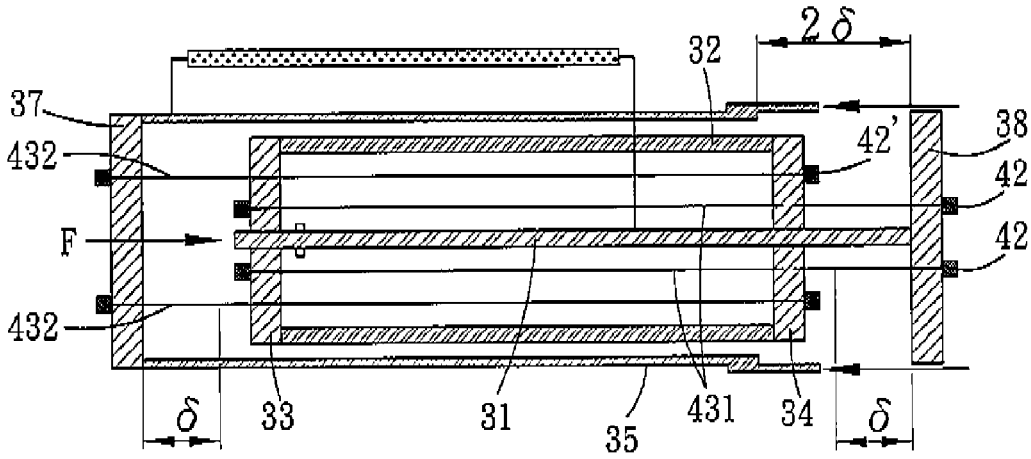
FIG. 22 is a schematic sectional view, of the fourth preferred embodiment, illustrating the mechanical performances of the components of the brace apparatus when a pushing force is applied.

With particular reference to FIGS. 17 and 22, when a pushing force (F) is applied to the brace apparatus, it is transmitted from the building onto the first core member 31 and, thus, the second outer abutment plate 38 via the extension section 311. Hence, the first tensioning elements 431 are pulled to transmit the force from the second outer abutment plate 38 onto the first inner abutment plate 33. Thereafter, the force is transmitted from the first inner abutment plate 33 onto the second inner abutment plate 34 by the second core member 32, from the second inner abutment plate 34 onto the first outer abutment plate 37 by the second tensioning elements 432, and finally from the first outer abutment plate 37 onto the building via the outer sleeve 35.

Figure 23:
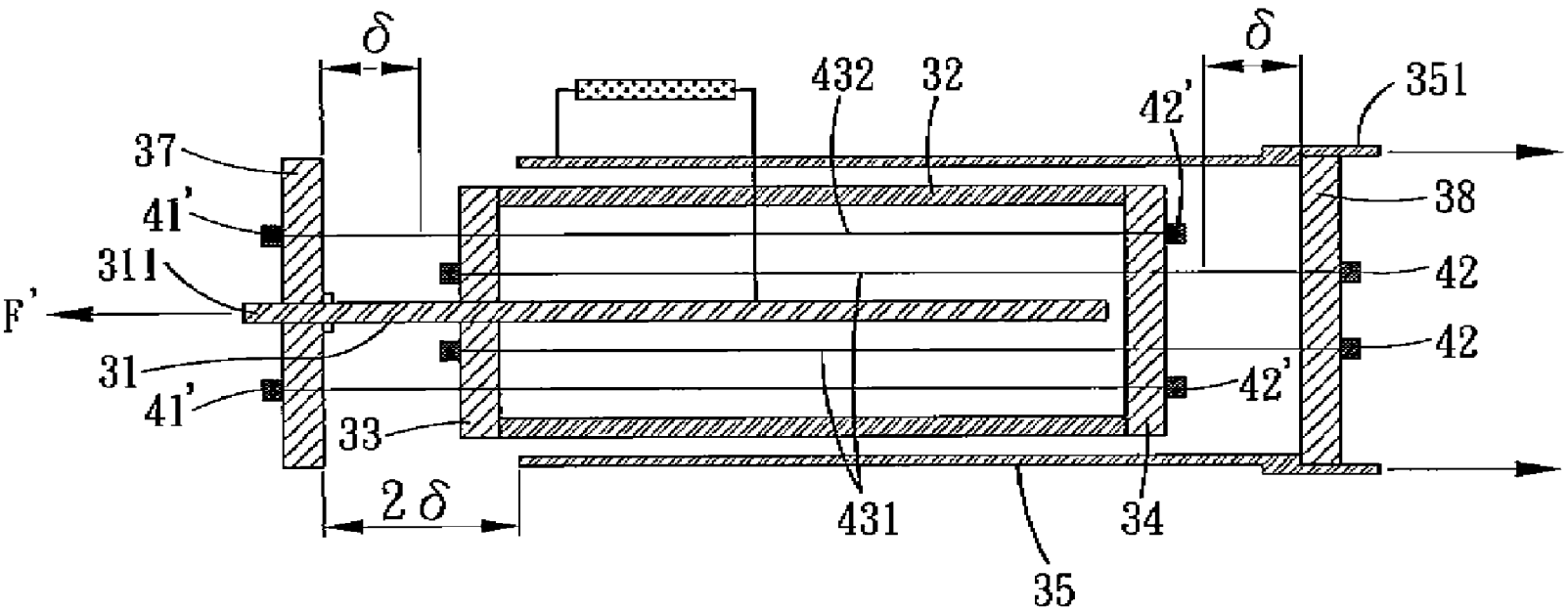
FIG. 23 is a schematic sectional view of the fourth preferred embodiment, illustrating the mechanical performances of the components of the brace apparatus when a pulling force is applied.
Figure 24:
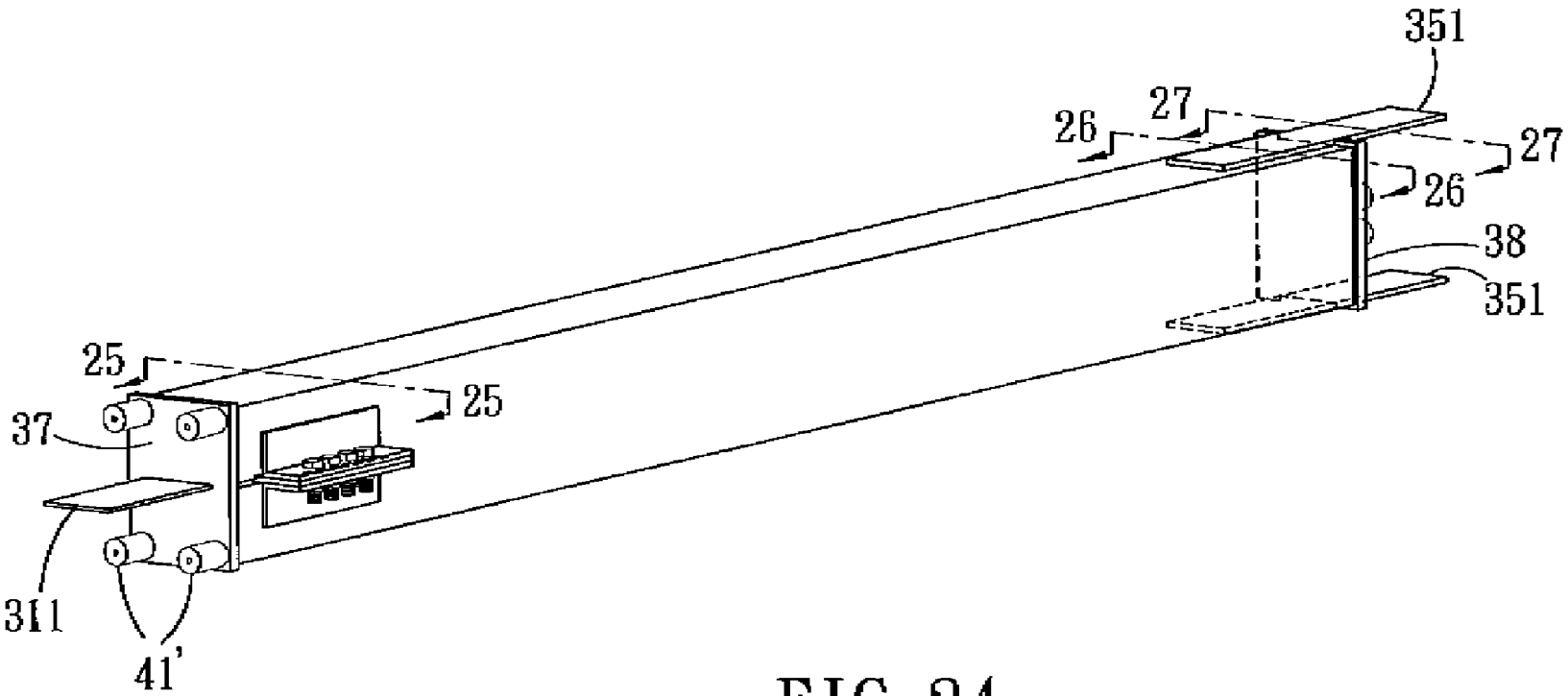
FIG. 24 is a sectional view of the fifth preferred embodiment of a dual-core self-centering brace apparatus according to this invention.
Figure 26:
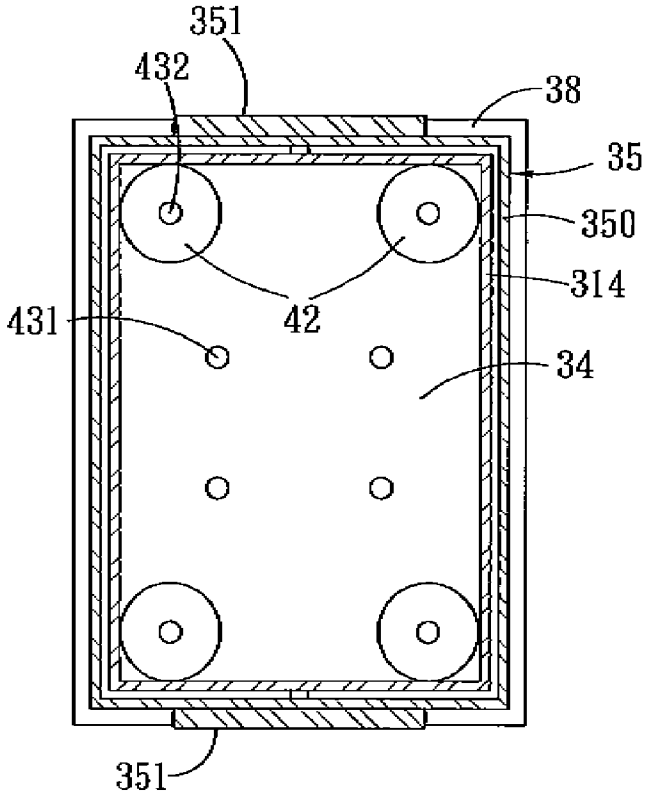
FIG. 26 is a sectional view taken along line 26-26 in FIG. 24.
Figure 25:
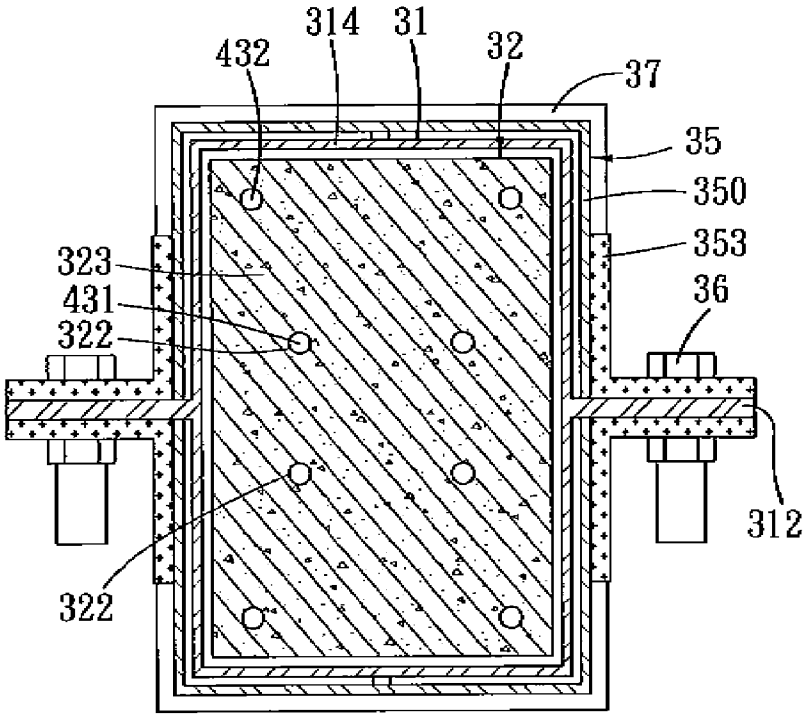
FIG. 25 is a sectional view taken along line 25-25 in FIG. 24.
Figure 27:
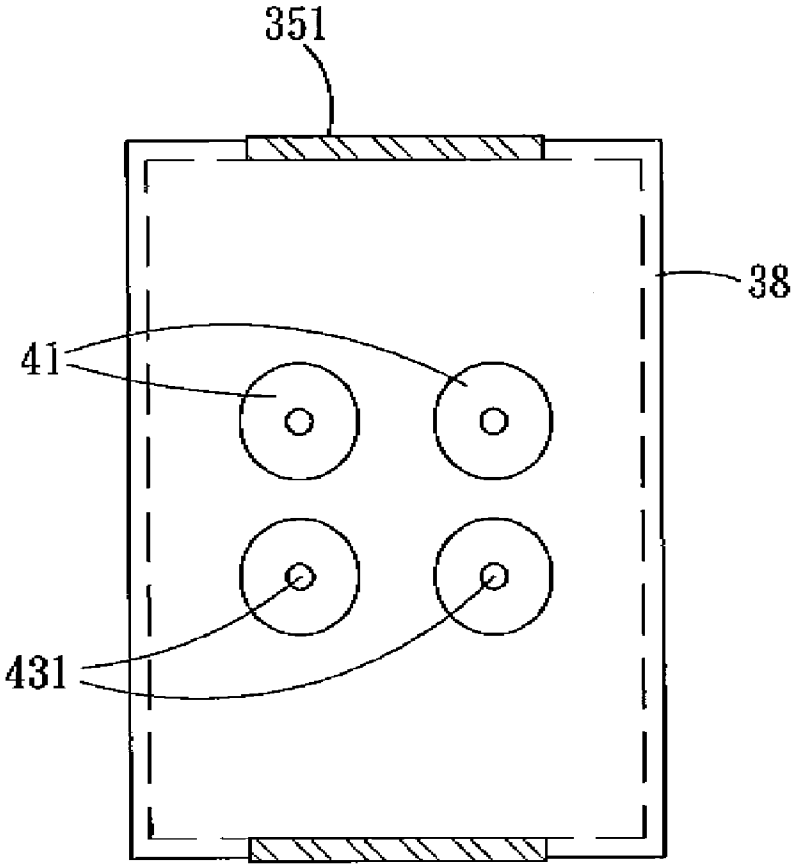
FIG. 27 is a sectional view taken along line 27-27 in FIG. 24.

With particular reference to FIGS. 17 and 23, when a pulling force (F') is applied to the brace apparatus, it is transmitted from the building onto the first outer abutment plate 37 via the extension section 311. Hence, the force is transmitted from the first outer abutment plate 37 onto the second inner abutment plate 34 by the second tensioning elements 432, from the second inner abutment plate 34 onto the first inner abutment plate 33 by the second core member 32, from the first inner abutment plate 33 onto the second outer abutment plate 38 by the first tensioning elements 431, and finally from the second outer abutment plate 38 onto the building via the outer sleeve 35.

As such, when the brace apparatus is subjected to a pushing or pulling force, relative movement occurs among the first and second core members 31, 32, and the outer sleeve 35. During relative movement between the first core member 31 and the outer sleeve 35, the energy-dissipating unit is used to retard the relative movement. As shown in FIGS. 22 and 23, in this state, since the length of each of the first and second tensioning elements 431, 432 is increased by an elongation amount (δ), the total length of the first core member 31 and the outer sleeve 35 is increased by an increment of 2 δ, which is two times that of the above-mentioned brace apparatus without causing any structural damage.

FIGS. 24 to 27 show the fifth preferred embodiment of a dual-core self-centering brace apparatus according to this invention, which is similar in construction to the fourth preferred embodiment. Unlike the fourth preferred embodiment, the main body of the first core member 31 is configured as a steel tube 314, and the energy-dissipating plates 312 extend respectively from two opposite sides of the steel tube 314. The second core member 32 includes a preformed concrete block 323, and a plurality of thin tubes 322 embedded within the concrete block 323 for extension of the first and second tensioning elements 431, 432 therein, respectively.

Figure 28:
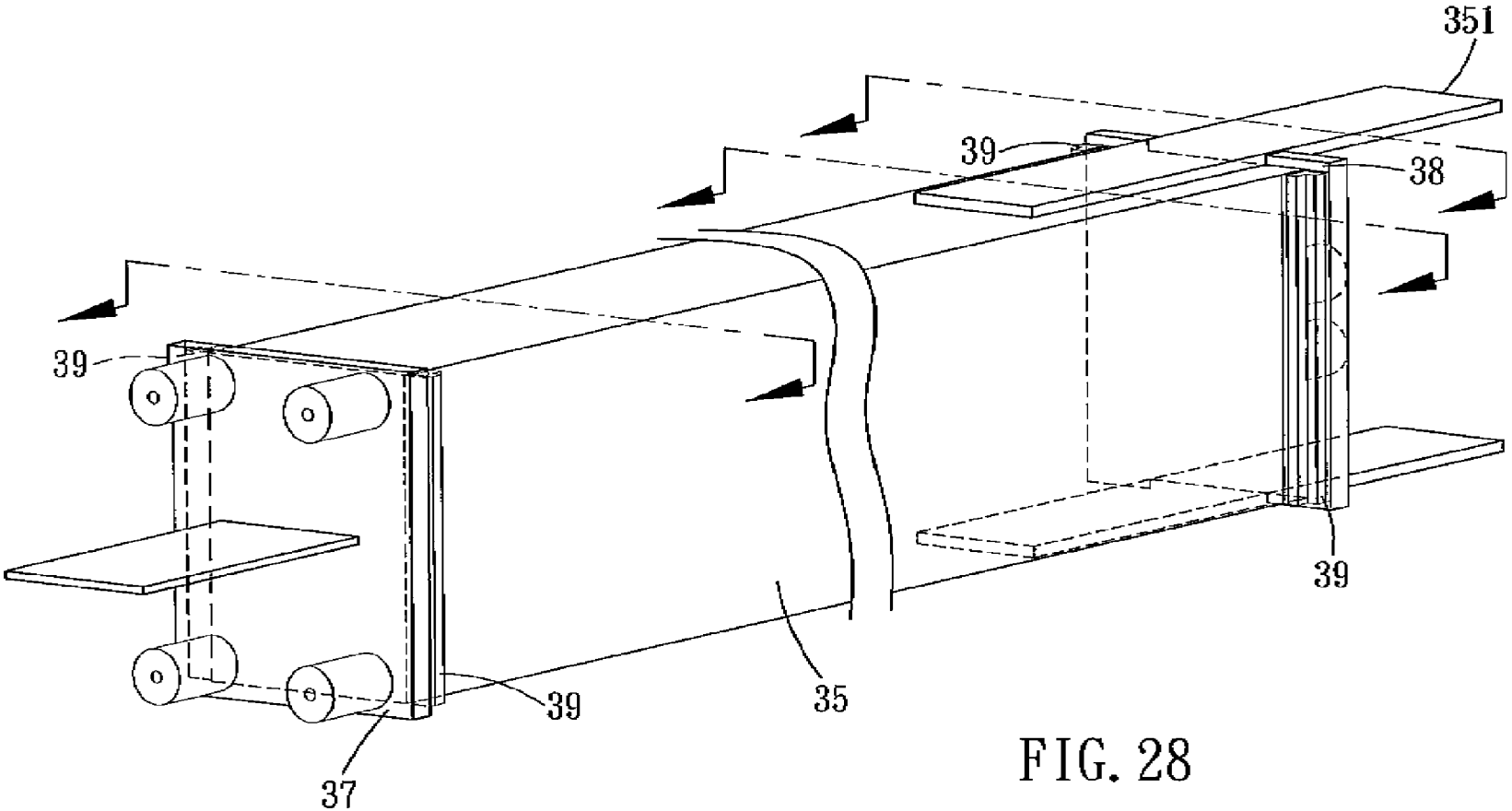
FIG. 28 is an assembled perspective view of the sixth preferred embodiment of a dual-core self-centering brace apparatus according to this invention.

FIG. 28 shows the sixth preferred embodiment of a dual-core self-centering brace apparatus according to this invention, which is similar in construction to the fourth preferred embodiment except for the energy-dissipating unit. In this embodiment, the first and second outer abutment plates 37, 38 are enlarged, and the energy-dissipating plates 312 are replaced with two bent energy-dissipating plates 39 each configured as an angle steel. One of the bent energy-dissipating plates 39 is disposed between the outer sleeve 35 and the first outer abutment plate 37, and the other of the bent energy-dissipating plates 39 is disposed between the outer sleeve 35 and the second outer abutment plate 38.

In view of the above, the elongation amount of the brace apparatus is increased considerably. Thus, the object of this invention is achieved.

With this invention thus explained, it is apparent that numerous modifications and variations can be made without departing from the scope and spirit of this invention. It is therefore intended that this invention be limited only as indicated by the appended claims.

We claim:

1. A brace apparatus adapted to be connected to a building, said brace apparatus comprising:

an elongate first core member having a main body and at least one extension section connected fixedly to said main body and adapted to connect with the building;

at least one elongate second core member parallel to said first core member;

an outer sleeve including an outer steel tube disposed around said first and second core members and having an inner surface facing said first and second core members, and at least one steel plate connected fixedly to an end of said outer steel tube and adapted to connect with the building;

a pair of first and second inner abutment plates respectively adjacent to two opposite ends of said first core member, two ends of said second core member abutting respectively against said first and second inner abutment plates;

a pair of first and second outer abutment plates abutting respectively against two opposite ends of said outer sleeve;

at least one first tensioning element adjacent to said first core member and extending in said outer sleeve along a longitudinal direction of said first core member, said first tensioning element being fastened to said first inner abutment plate at an end thereof and to one of said second inner and outer abutment plates at an opposite end thereof;

at least one second tensioning element extending in said outer sleeve in a longitudinal direction of said outer sleeve and adjacent to said inner surface of said outer sleeve, said second tensioning element being fastened to said first outer abutment plate at an end thereof and to one of said second inner and outer abutment plates at an opposite end thereof; and an energy-dissipating unit for retarding relative movement between said first core member and said outer sleeve and between said first and second outer abutment plates;

wherein, when a force is applied to said first core member, relative movement occurs between said first inner and outer abutment plates, between said second inner and outer abutment plates, and among said first and second core members and said outer sleeve, so that the length of each of said first and second tensioning elements is increased by an elongation amount, and the total length of said first core member and said outer sleeve is increased by an amount that is two times the elongation amount.

2. The brace apparatus as claimed in claim 1, wherein each of said first and second outer abutment plates is configured as a rectangular frame defining an accommodating space, said first inner abutment plate being disposed within said accommodating space in said first outer abutment plate and being coplanar with said first outer abutment plate, said second inner abutment plate being disposed within said accommodating space in said second outer abutment plate and being coplanar with said second outer abutment plate, said first tensioning element being fastened to said first and second inner abutment plates, said second tensioning element being fastened to said first and second outer abutment plates.

3. The brace apparatus as claimed in claim 1, wherein said first and second inner abutment plates are disposed between said first and second outer abutment plates, said first tensioning element being fastened to said first inner abutment plate and said second outer abutment plate, said second tensioning element being fastened to said first outer abutment plate and said second inner abutment plate.

4. The brace apparatus as claimed in claim 1, wherein said energy-dissipating unit includes at least one energy-dissipating plate extending from an outer surface of said main body of said first core member, said outer steel tube of said outer sleeve being formed with a slot permitting extension of said energy-dissipating plate therethrough, said energy-dissipating unit further including a pair of angle steels located respectively to two sides of said slot and interconnected fixedly for clamping said energy-dissipating plate therebetween.

5. The brace apparatus as claimed in claim 4, wherein said energy-dissipating unit further includes a lock bolt for interconnecting said angle steels fixedly.

6. The brace apparatus as claimed in claim 4, wherein said energy-dissipating unit further includes an adhesive elastic damping material disposed between said angle steels for interconnecting said angle steel fixedly.

7. The brace apparatus as claimed in claim 1, wherein said energy-dissipating unit includes two bent energy-dissipating plates each configured as an angle steel, one of said bent energy-dissipating plates being disposed between said outer sleeve and said first outer abutment plate, the other of said bent energy-dissipating plates being disposed between said outer sleeve and said second outer abutment plate.

8. The brace apparatus as claimed in claim 1, wherein said first core member is H-shaped in cross section, and has two upright side plate portions and a generally horizontal middle plate portion connected between said side plate portions, said brace apparatus comprising two said second core members each including an inner steel tube, each of said inner steel tubes of said second core members being disposed between said side plate portions of said first core member, one of said inner steel tubes being disposed above said middle plate portion, the other of said inner steel tubes being disposed under said middle plate portion, said brace apparatus comprising two sets of said first tensioning elements disposed respectively within said inner steel tubes, the number of one set of said first tensioning elements being the same as that of the other set of said first tensioning elements.

9. The brace apparatus as claimed in claim 8, wherein said first core member includes two said extension sections welded respectively to said side plate portions, said outer sleeve including two said steel plates welded respectively to two opposite side surfaces.

10. The brace apparatus as claimed in claim 8, wherein said extension section is welded to said middle plate portion of said first core member, said outer sleeve including two said steel plates welded respectively to two opposite side surfaces of said outer tube.

11. The brace apparatus as claimed in claim 1, wherein said main body of said first core member is H-shaped in cross section, and said second core member including an inner steel tube disposed around said main body of said first core member.

12. The brace apparatus as claimed in claim 1, wherein said main body of said first core member is configured as a steel tube, and said second core member including a concrete block, and a plurality of thin tubes embedded within said concrete block for extension of said first and second tensioning elements therein, respectively.

* * * * *